US008372796B2

(12) United States Patent
Rigley et al.

(10) Patent No.: US 8,372,796 B2
(45) Date of Patent: Feb. 12, 2013

(54) SOLID CLEANING PRODUCTS

(75) Inventors: Karen O. Rigley, Greensboro, NC (US); Tami Jo Tadrowski, Greensboro, NC (US); Peter J. Barnett, Eden Prairie, MN (US)

(73) Assignee: Ecolab USA Inc., St. Paul, MN (US)

( * ) Notice: Subject to any disclaimer, the term of this patent is extended or adjusted under 35 U.S.C. 154(b) by 74 days.

(21) Appl. No.: 12/953,293

(22) Filed: Nov. 23, 2010

(65) Prior Publication Data

US 2011/0065623 A1 Mar. 17, 2011

Related U.S. Application Data

(63) Continuation of application No. 11/074,952, filed on Mar. 7, 2005, now Pat. No. 7,863,237.

(60) Provisional application No. 60/551,619, filed on Mar. 8, 2004.

(51) Int. Cl.
*C11D 17/00* (2006.01)

(52) U.S. Cl. ..... 510/475; 510/214; 134/42

(58) Field of Classification Search ..... 510/475, 510/214; 134/42
See application file for complete search history.

(56) References Cited

U.S. PATENT DOCUMENTS

| | | | | | |
|---|---|---|---|---|---|
| 4,501,680 | A | * | 2/1985 | Aszman et al. | 510/238 |
| 4,749,508 | A | | 6/1988 | Cockrell, Jr. et al. | |
| 4,826,661 | A | * | 5/1989 | Copeland et al. | 422/106 |
| 4,877,459 | A | | 10/1989 | Cockrell, Jr. et al. | |
| 5,108,642 | A | * | 4/1992 | Aszman et al. | 510/375 |
| 5,205,955 | A | | 4/1993 | Bunczk et al. | |
| 5,286,403 | A | | 2/1994 | O'Dwyer et al. | |
| 5,665,427 | A | | 9/1997 | Horne et al. | |
| 5,698,021 | A | | 12/1997 | Dorsett | |
| 5,885,339 | A | | 3/1999 | Dorsett | |
| 5,929,011 | A | * | 7/1999 | Scepanski | 510/294 |
| 6,028,113 | A | * | 2/2000 | Scepanski | 514/643 |
| 6,217,889 | B1 | | 4/2001 | Lorenzi et al. | |
| 6,288,016 | B1 | | 9/2001 | Ramanan et al. | |
| 6,423,674 | B1 | | 7/2002 | Williams et al. | |
| 6,432,906 | B1 | * | 8/2002 | Carlson et al. | 510/446 |
| 6,518,313 | B1 | * | 2/2003 | Scepanski | 514/642 |
| 6,660,707 | B2 | * | 12/2003 | Lentsch et al. | 510/445 |
| 2002/0107164 | A1 | * | 8/2002 | Klaers et al. | 510/356 |
| 2003/0073603 | A1 | | 4/2003 | Hafkamp et al. | |
| 2005/0197276 | A1 | * | 9/2005 | Rigley et al. | 510/446 |
| 2006/0116306 | A1 | * | 6/2006 | Patien et al. | 510/191 |

FOREIGN PATENT DOCUMENTS

| | | | |
|---|---|---|---|
| CA | 2 467 198 | A1 | 5/2003 |
| FR | 2 730 503 | A1 | 8/1996 |
| WO | WO 97/04067 | | 2/1997 |

OTHER PUBLICATIONS

International Search Report mailed Nov. 3, 2005.
The Merck Index. An Encyclopedia of Chemicals, Drugs, and Biologicals, 13 Edition, pp. 405-406 (2001).

* cited by examiner

*Primary Examiner* — Mark Eashoo
*Assistant Examiner* — M. Reza Asdjodi
(74) *Attorney, Agent, or Firm* — Merchant & Gould P.C.

(57) ABSTRACT

Solid cleaning products suitable for use as a floor cleaner are disclosed. The solid cleaning products are essentially free of unbound water and include an acid, an anionic surfactant, a nonionic surfactant and a builder. The present invention also discloses methods of using the solid cleaning products by dissolving the solid cleaning product in water to form a use solution; and applying the use solution to a floor.

8 Claims, 3 Drawing Sheets

SOLID CLEANING PRODUCTS

CROSS-REFERENCE TO RELATED APPLICATIONS

This application is a continuation of U.S. patent application Ser. No. 11/074,952, filed Mar. 7, 2005, which claims the benefit of priority to U.S. provisional patent application Ser. No. 60/551,619, filed on Mar. 8, 2004, all of which are hereby incorporated by reference in their entirety.

FIELD OF THE INVENTION

The present invention relates to solid cleaning products suitable, for example, for use as a floor cleaner. The present invention also relates to methods of making and using solid cleaning products.

BACKGROUND OF THE INVENTION

Removal of airborne grease and polymerized soil from quarry tile floors and other flooring surfaces has posed a problem in the art for many years. A number of liquid cleaning products have been used to remove or attempt to remove airborne grease and polymerized soil from flooring surfaces.

Liquid products, such as liquid cleaning products, are used throughout residential and commercial properties in a variety of applications including the removal of airborne grease and polymerized soil from flooring surfaces. Although liquid products have tremendous utility, liquid products have a number of shortcomings. One primary shortcoming is the bulkiness and weight of liquid products. Packaged liquid products are usually either made relatively small to keep the weight low, or made relatively large causing an undesirable increase in product weight.

Solid products are generally more convenient, safe and economical than liquid products because they do not spill or splash, have reduced manufacturing and distribution costs, and require less storage space. However, solid products must first be converted to a liquid before they can be used in most applications. Typically, a product dispenser is used to bring water into contact with a solid product in order to dissolve the solid product and produce a resulting liquid "use" solution that can be transferred to a vessel or onto a surface to be cleaned.

There is a need in the art for a solid cleaning product for use in residential, commercial, and industrial applications that effectively removes airborne grease and polymerized soil from quarry tile floors and other flooring surfaces.

SUMMARY OF THE INVENTION

The present invention addresses some of the difficulties and problems discussed above by the discovery of a solid cleaning product that can effectively remove airborne grease and polymerized soil from quarry tile floors and other flooring surfaces. The solid cleaning product may be used in a variety of product dispensing systems to produce a liquid use solution. The liquid use solution is prepared by contacting the solid cleaning product with water such that the solid cleaning product dissolves, producing a liquid use solution having a desired concentration of solid product dispersed therein.

Accordingly, the present invention is directed to a solid cleaning product and a liquid use solution prepared from the solid cleaning product. In one exemplary embodiment of the present invention, the solid cleaning product includes a solid cleaning product including at least one acid, wherein the solid cleaning product is essentially free of unbound water. The exemplary solid cleaning product may further include a number of additional ingredients including, but not limited to, at least one anionic surfactant, at least one nonionic surfactant, at least one builder, at least one process aid, at least one colorant, or at least one fragrance. The exemplary solid cleaning product may be in the form of particles, powder, a solid mass including a plurality of particles, a solid block (e.g., a molded product), or an extruded product.

In a further exemplary embodiment of the present invention, the solid cleaning product includes a solid cleaning product containing (a) at least one acid; (b) at least one anionic surfactant; (c) at least one nonionic surfactant; (d) at least one builder; (e) an optional process aid; and (f) one or more optional additives selected from the group consisting of colorants, fragrances, and chelating agents; wherein the solid cleaning product is essentially free of water, and the solid cleaning product contains at least 40 percent by weight (wt-%) of one or more anionic surfactants in combination with one or more nonionic surfactants, based on a total weight of the solid cleaning product. In this embodiment, the solid cleaning product may contain at least 50 wt-%, and in some embodiments, at least 60 wt-% of one or more anionic surfactants in combination with one or more nonionic surfactants, based on a total weight of the solid cleaning product. In this embodiment, the solid cleaning product may also be in the form of particles, powder, a solid mass including a plurality of particles, a solid block (e.g., a molded product), or an extruded product.

The present invention is further directed to a method of making solid cleaning products. The method of making solid cleaning products may include a variety of process steps depending on the desired configuration of the final solid cleaning product. In an exemplary method of making solid cleaning products, the method includes the steps of: (i) adding one or more solid cleaning product components to a mixing vessel; and (ii) mixing the one or more solid cleaning product components via a mechanical stirrer for a desired period of time. In a further exemplary method, the method includes the steps of: (i) feeding one or more solid cleaning product components into an extruder; and (ii) extruding the one or more solid cleaning product components to form an extruded solid cleaning product having a desired size and shape.

The present invention is also directed to a product dispenser system including a product dispenser in combination with one or more solid cleaning products. In one exemplary embodiment of the present invention, the product dispensing system includes (I) a product dispenser including (a) a cavity suitable for housing a solid cleaning product; (b) a sealable opening within the cavity suitable for inserting a solid cleaning product into the cavity; and (c) at least one water inlet into the cavity, which may also serve as a use solution outlet out of the cavity; and (II) at least one piece of solid cleaning product including at least one acid, wherein the solid cleaning product is essentially free of unbound water. The one or more pieces of solid cleaning product may be positioned within the product dispenser of the product dispensing system. When water contacts the solid cleaning product, the solid cleaning product dissolves to form a liquid use solution, which may be used in a number of applications.

The present invention is even further directed to a method of making a liquid solution using a product dispensing system. The method provides a liquid use solution having a desired concentration of one or more active ingredients. One exemplary method of making a liquid solution using a product dispensing system of the present invention includes (a) positioning a product dispensing system relative to a water source; (b) placing one or more pieces of solid cleaning product in a product dispenser of the product dispensing system; and (c) contacting the one or more pieces of solid cleaning product with water to form a liquid use solution.

The solid cleaning products and product dispensing systems of the present invention may be used in a number of applications. One exemplary application includes the preparation of a liquid use solution suitable for effectively removing airborne grease, polymerized soil and other dirt from quarry tile floors and other flooring surfaces.

These and other features and advantages of the present invention will become apparent after a review of the following detailed description of the disclosed embodiments and the appended claims.

DETAILED DESCRIPTION OF THE INVENTION

Figure 1:
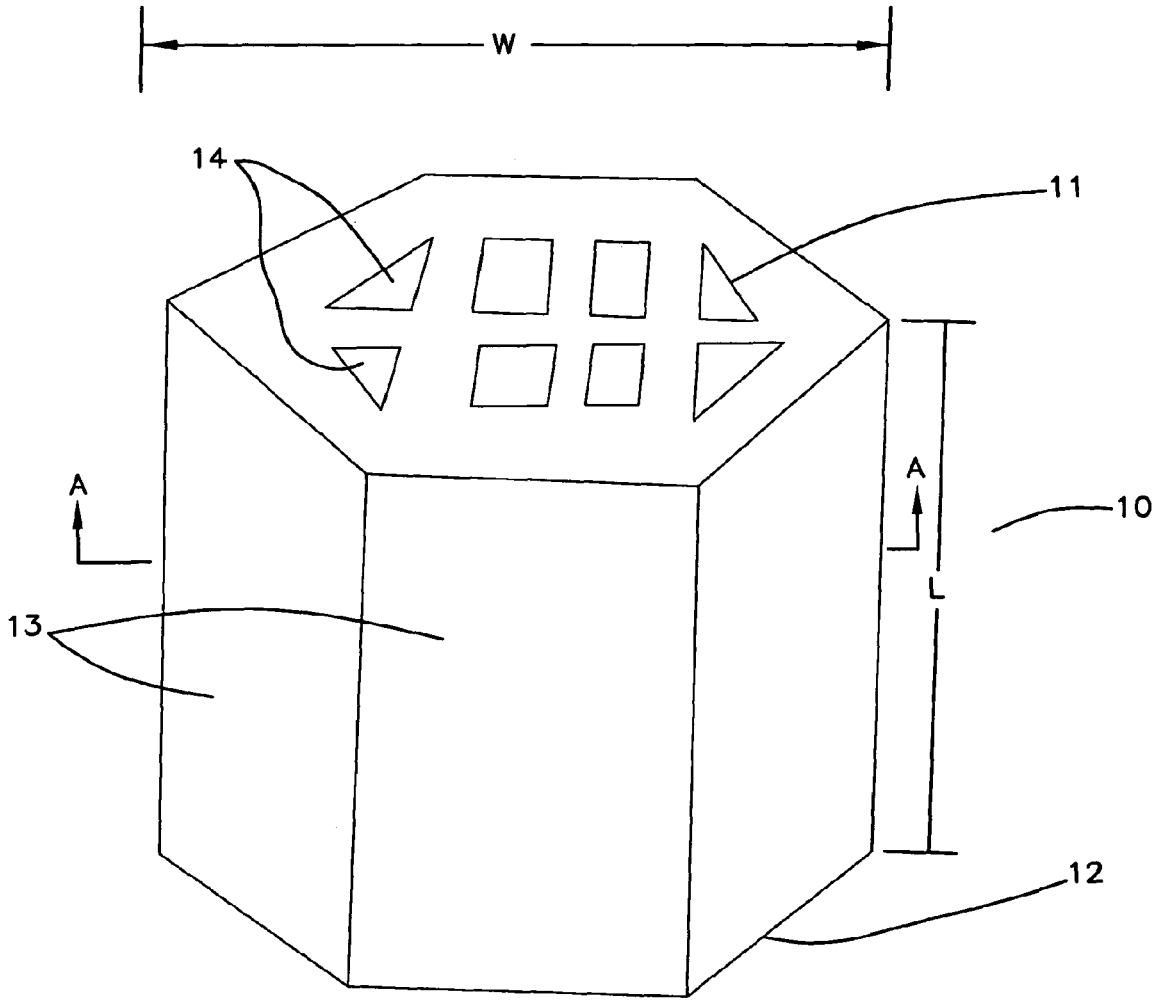
FIG. 1 depicts an exemplary solid cleaning product of the present invention.

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

The present invention relates to a solid cleaning product suitable for use as a floor cleaning product. In an embodiment, the solid cleaning product is a solid product including a combination of one or more ingredients so as to result in an effective cleaning product. The solid cleaning product of the present invention is essentially free of "unbound" or "free" water. As used herein, the terms "unbound" water and "free" water are used interchangeably to describe water added to a given composition as a separate ingredient. The terms "unbound" water and "free" water do not include water bound to a compositional component, such as a hydrated salt (e.g., sodium citrate dihydrate). As used herein, the term "essentially free of unbound or free water" refers to a product that is produced using a minimal amount, if any, of unbound or free water so that the resulting product contains less than about 10 percent by weight unbound or free water, based on a total weight of the solid product. In an embodiment, the solid product contains less than about 5.0 (about 4.0, about 3.0, about 2.0) percent by weight unbound or free water, even less than about 1.0 percent by weight unbound or free water, based on a total weight of the solid product.

In certain embodiments, the solid cleaning products of the present invention are also essentially free of a fluorine-containing component. As used herein, the term "essentially free of a fluorine-containing component" refers to a solid cleaning product that is produced without the intentional inclusion of any fluorine-containing components. In an embodiment, the solid product contains less than about 0.5 percent by weight fluorine-containing components, even less than about 0.1 percent by weight fluorine-containing components, based on a total weight of the solid product.

The present invention also relates to a product dispensing system for forming a liquid "use" solution from water and at least one piece of the solid cleaning product. As used herein, the terms "use solution" and "liquid use solution" refer to an aqueous solution resulting from the interaction of water and a solid cleaning product within a product dispenser. The product dispensing systems of the present invention include a product dispenser in combination with one or more additional system components. Desired use solutions, such as floor cleaning solutions, may be prepared using the product dispensing systems of the present invention as described below.

I. Solid Cleaning Products

The solid cleaning products of the present invention include a number of components, which provide desired characteristics to the resulting solid product. Further, the solid cleaning products of the present invention possess a physical shape and configuration that provides one or more use advantages when compared to conventional liquid cleaning products.

A. Solid Cleaning Product Components

A description of each class of solid product component is given below.

1. Acid Component

The solid cleaning product of the present invention includes at least one acid. In an embodiment, the acids used in the present invention have a $pK_a$ value of greater than about 2.8 at 25° C. Suitable acids for use in the present invention include, but are not limited to, citric acid (i.e., 2-hydroxy-1,2,3-propanetricarboxylic acid), lactic acid, tartaric acid, glycolic acid, salicylic acid, 1,4-piperazinebis-(ethanesulfonic acid) (PIPES), fumaric acid, malic acid, itaconic acid, ascorbic acid, succinic acid, and benzoic acid. In an embodiment, the solid cleaning product of the present invention includes at least one acid in the form of anhydrous citric acid.

The solid cleaning product of the present invention can include up to about 40 percent by weight (wt-%) of one or more acids based on a total weight of the solid cleaning product. In certain embodiments, the solid cleaning product of the present invention includes from about 5 to about 35 wt-%, for example, from about 10 to about 30 wt-%, or, for example, from about 16 to about 24 wt-% of one or more acids based on a total weight of the solid cleaning product.

In one desired embodiment of the present invention, the solid cleaning product includes a solid cleaning product containing about 20 wt-% of one or more acids having a $pK_a$ value of greater than about 2.8 at 25° C. based on a total weight of the solid cleaning product, wherein the one or more acids include citric acid alone or in combination with other acids.

In a further embodiment of the present invention, the solid cleaning product contains a single acidic component, wherein the single acidic component includes anhydrous citric acid. In this embodiment, the solid cleaning product may be in the form of particles, powder, a solid mass including a plurality of particles, a solid block (e.g., a molded product), or an extruded product.

A number of commercially available acids may be used in the present invention. Suitable commercially available acids include, but are not limited to, citric acid available from Archer Daniels Midland Company (Decatur, Ill.).

2. Anionic Surfactants

The solid cleaning products of the present invention may further include one or more anionic surfactants. Suitable anionic surfactants for use in the present invention include, but are not limited to, dodecylbenzene sulfonic acid and its salts, alkyl ether sulfates and salts thereof, alkyl diphenyl oxide disulfonates, olefin sulfonates, phosphate esters, soaps, sulfosuccinates, and alkyaryl sulfonates. In an embodiment, the anionic surfactant includes sodium dodecylbenzene sulfonate.

The solid cleaning product of the present invention can include up to about 75 percent by weight (wt-%) of one or more anionic surfactants based on a total weight of the solid cleaning product. In certain embodiments, the solid cleaning product of the present invention includes from about 35 to about 65 wt-%, for example, from about 40 to about 60 wt-%, or, for example, from about 45 to about 55 wt-% of one or more anionic surfactants based on a total weight of the solid cleaning product.

In one desired embodiment of the present invention, the solid cleaning product includes a solid cleaning product containing about 50 wt-% of one or more anionic surfactants based on a total weight of the solid cleaning product, wherein the one or more anionic surfactants include sodium dodecylbenzene sulfonate alone or in combination with other anionic surfactants.

In a further embodiment of the present invention, the solid cleaning product contains one or more anionic surfactants, wherein the one or more anionic surfactants represent at least 40, for example, at least 49 wt-% of the total weight of the solid cleaning product. In this embodiment, the solid cleaning product may be in powder form or may be an extruded solid cleaning product.

A number of commercially available anionic surfactants may be used in the present invention. Suitable commercially available anionic surfactants include, but are not limited to, linear alkylbenzene sulfonate surfactants sold under the trade designation NACCONOL®, available from Stepan Chemical Company (Northfield, Ill.), such as NACCONOL® 40 g and NACCONOL® 90 g; and alkyl diphenyl oxide disulfonates sold under the trade designation RHODACAL®, available from Rhodia North America (Spartanburg, S.C.), such as RHODACAL® DSB (disodium dodecyl diphenyl oxide disulfonate) and RHODACAL® DSB 85 (disodium dodecyl diphenyl oxide disulfonate). In an embodiment, the anionic surfactant used in the present invention includes NACCONOL® 90 g. NACCONOL® 90 g has a moisture content (i.e., unbound or free water content) of less than about 2.0 wt-%, an alcohol insolubles content of less than about 5.5 wt-%, and a sodium chloride content of less than about 0.2 wt-%, based on a total weight of the powder surfactant.

3. Nonionic Surfactants

The solid cleaning products of the present invention may also include one or more nonionic surfactants. Suitable nonionic surfactants for use in the present invention include, but are not limited to, alkoxylates of alkyl phenols and alcohols, alkanolamides, amine oxides, alkyl polyglycocides, coconut amide surfactants, and lauryl amide surfactants. Suitable ethoxylated alcohols include, but are not limited to, ethoxylated alcohols having from about 9 to about 15 carbon atoms. Suitable nonyl phenoxy ethoxylates include, but are not limited to, nonyl phenoxy ethoxylates having from about 4 to about 12 moles of ethylene oxide, for example, from about 7 to about 11 moles of ethylene oxide. In an embodiment, the nonionic surfactant includes one or more ethoxylated alcohols having from about 10 to about 12 carbon atoms.

The solid cleaning product of the present invention can include up to about 30 percent by weight (wt-%) of one or more nonionic surfactants based on a total weight of the solid cleaning product. In certain embodiments, the solid cleaning product of the present invention includes from about 5 to about 25 wt-%, for example, from about 10 to about 20 wt-%, and or, for example, from about 12 to about 18 wt-% of one or more nonionic surfactants based on a total weight of the solid cleaning product.

In one desired embodiment of the present invention, the solid cleaning product includes a solid cleaning product containing about 15 wt-% of one or more nonionic surfactants based on a total weight of the solid cleaning product, wherein the one or more nonionic surfactants include ethoxylated alcohols having from about 10 to about 12 carbon atoms alone or in combination with other nonionic surfactants.

In a further embodiment of the present invention, the solid cleaning product contains one or more anionic surfactants in combination with one or more nonionic surfactants, wherein the total amount of anionic and nonionic surfactants represent at least 40, for example, at least about 50 wt-%, or, for example, at least about 60 wt-% of the total weight of the solid cleaning product. In this embodiment, the solid cleaning product may be in powder form or may be an extruded solid cleaning product.

A number of commercially available nonionic surfactants may be used in the present invention. Suitable commercially available nonionic surfactants include, but are not limited to, ethoxylated alcohols having from about 9 to about 15 carbon atoms and sold under the trade designation SURFONIC®, available from Huntsman Chemical Company (Houston, Tex.), such as SURFONIC® L12-6 (i.e., average of six moles of ethylene oxide) and SURFONIC® L12-3 (i.e., average of three moles of ethylene oxide); surfactants sold under the trade designation NEODOL®, available from Shell Chemical Co. (Houston, Tex.), such as NEODOL® 91-6 and NEODOL® 91-2.5; and surfactants sold under the trade designation TOMADOL®, available from Tomah[3] Products, Inc. (Milton, Wis.), such as TOMADOL® 1-5 (i.e., average of five moles of ethylene oxide), TOMADOL® 91-6 (equivalent to NEODOL® 91-6), and TOMADOL® 91-2.5 (equivalent to NEODOL® 91-2.5); nonyl phenoxy ethoxylates sold under the trade designation SURFONIC®, available from Huntsman Chemical Company (Houston, Tex.), such as SURFONIC® N-95; diethanol coconut amide surfactants including, but are not limited to, surfactants available under the trade designation NINOL, available from the Stepan Chemical Company (Northfield, Ill.), such as NINOL 40-CO, surfactants sold under the trade designation STANDAMID™, available from Henkel, Canada Ltd. (Ontario, Canada), such as STANDAMID™ SD, and surfactants sold under the trade designation WITCAMIDE, available from Witco Corporation (Greenwich, Conn.), such as WITCAMIDE 82. In an embodiment, the nonionic surfactant used in the present invention includes SURFONIC® L12-6.

4. Builders

The solid cleaning products of the present invention may also include one or more builders. Suitable builders for use in the present invention include, but are not limited to, sodium citrate dihydrate (i.e., trisodium 2-hydroxy-1,2,3-propanetricarboxylate dihydrate), sodium tripolyphosphate, sodium acid pyrophosphate (SAPP), sodium bicarbonate, and monosodium phosphate. In an embodiment, the builder includes sodium citrate dihydrate.

The solid cleaning product of the present invention can include up to about 30 percent by weight (wt-%) of one or more builders based on a total weight of the solid cleaning product. In certain embodiments, the solid cleaning product of the present invention includes from about 5 to about 25 wt-%, for example, from about 10 to about 20 wt-%, or, for example, from about 12 to about 18 wt-% of one or more builders based on a total weight of the solid cleaning product.

In one desired embodiment of the present invention, the solid cleaning product includes a solid cleaning product containing from about 13 to about 15 wt-% of one or more builders based on a total weight of the solid cleaning product, wherein the one or more builders include sodium citrate dihydrate alone or in combination with other builders.

A number of commercially available builders may be used in the present invention. Suitable commercially available builders include, but are not limited to, sodium citrate dihydrate available from Haarmann & Reimer Corporation (Elkhart, Ind.).

5. Process Aids

The solid cleaning products of the present invention may further include one or more optional process aids. Such optional process aids may provide one or more processing advantages during processing of the above-described solid cleaning product components and/or one or more desirable properties to the resulting solid cleaning product. Suitable process aids for use in the present invention include, but are not limited to, sodium sulfate, sodium chloride, potassium sulfate, potassium chloride and urea. In an embodiment, the process aid includes anhydrous sodium sulfate or urea.

The solid cleaning product of the present invention can include up to about 20 percent by weight (wt-%) of one or more process aids based on a total weight of the solid cleaning product. In certain embodiments, when present, the solid cleaning product of the present invention includes from greater than 0 to about 15 wt-%, for example, from about 1.0 to about 10 wt-%, or, for example, from about 3.0 to about 8.0 wt-% of one or more process aids based on a total weight of the solid cleaning product.

In one exemplary embodiment of the present invention, the solid cleaning product includes a solid cleaning product containing about 5.0 wt-% of one or more process aids based on a total weight of the solid cleaning product, wherein the one or more process aids include sodium sulfate alone or in combination with other process aids. In a further exemplary embodiment, the solid cleaning product includes a solid cleaning product containing about 10.0 wt-% of one or more process aids based on a total weight of the solid cleaning product, wherein the one or more process aids include urea alone or in combination with other process aids.

A number of commercially available process aids may be used in the present invention. Suitable commercially available process aids include, but are not limited to, sodium sulfate available from Haarmann & Reimer Corporation (Elkhart, Ind.), and urea available from Mallinckrodt Baker, Inc. (Phillipsburg, N.J.).

6. Chelating Agents

The solid cleaning products of the present invention may further include one or more chelating agents to provide one or more desired characteristics to the solid cleaning product. Suitable chelating agents for use in the present invention include, but are not limited to, sodium acid pyrophosphates (SAPP), polyaspartic acid, sodium gluconate, sodium glucoheptonate, trisodium N-hydroxyethylene diamine triacetate, trisodium salt of methyl glycine diacetic acid, ethylenediaminetetraacetic acid (EDTA) and sodium salts thereof, diethylenetriaminepentaacetic acid (DTPA) and sodium salts thereof, nitrilotriacetic acid (NTA) and sodium salts thereof, sodium salts of neutralized and partially neutralized polyacrylic acids (e.g., salts commercially available from Rohm and Haas (Philadelphia, Pa.) and sold under the trade designation ACUSOL®, such as ACUSOL® 445G, 445ND and 497ND), and combinations thereof.

The solid cleaning product of the present invention can include up to about 20 percent by weight (wt-%) of one or more chelating agents, when present, based on a total weight of the solid cleaning product. In certain embodiments, when present, the solid cleaning product of the present invention includes from greater than 0 to about 15 wt-%, for example, from about 1.0 to about 10 wt-%, or, for example, from about 3.0 to about 8.0 wt-% of one or more chelating agents based on a total weight of the solid cleaning product.

A number of commercially available chelating agents may be used in the present invention. Suitable commercially available chelating agents include, but are not limited to, the ACUSOL® products described above, and a variety of products commercially available from Akzo Nobel (Chicago, Ill.) under the trade designation DISSOLVINE®, such as DISSOLVINE® Z (crystalline EDTA acid), DISSOLVINE® 220-S (crystalline tetrasodium salt of EDTA), DISSOLVINE® NA2 (disodium salt of EDTA), DISSOLVINE® NA3 (trisodium salt of EDTA), DISSOLVINE® DZ (crystalline DTPA acid), DISSOLVINE® AZ (crystalline NTA acid), and DISSOLVINE® A-92 (trisodium salt of NTA).

7. Additives

The solid cleaning products of the present invention may contain one or more additives to provide a desired characteristic to the solid cleaning product. Suitable additives include, but are not limited to, colorants (i.e., dyes, pigments, etc.), perfumes, preservatives, antioxidants, UV stabilizers, and combinations thereof. In one desired embodiment of the present invention, the solid cleaning product includes at least one colorant to provide a desirable color, at least one perfume or fragrance to provide a desirable scent within the solid cleaning product.

In an embodiment, additives such as colorants, perfumes, antioxidants, UV stabilizers, and preservatives, are each individually present in an amount of less than about 0.5 wt-% based on a total weight of the solid cleaning product. In an embodiment, the amount of colorant in the solid cleaning product, when present, ranges from about 0.0005 to about 0.015 wt-% based on a total weight of the solid cleaning product. When a perfume or fragrance is present, the amount of perfume or fragrance can be from about 0.01 to about 0.25 wt % based on a total weight of the solid cleaning product. In an embodiment, when present, one or more preservatives are present in the solid cleaning product in an amount ranging from about 0.001 to about 0.01 wt % based on a total weight of the solid cleaning product.

A number of commercially available additives may be used in the present invention. Commercially available colorants suitable for use in the present invention include, but are not limited to, Bright Green LX 6545 available from Pylam Products (Tempe, Ariz.); Blue Pylaklor LX 10092 available from Pylam Products (Tempe, Ariz.); Resorcine Brown 5GM available from Pylam Products (Tempe, Ariz.); and Tartrazine Yellow available from Chemcentral (Romulus, Mich.). Commercially available perfumes suitable for use in the present invention include, but are not limited to, Herbal SZ-6249 available from J. E. Sozio, Inc. (Edison, N.J.); perfume SZ-6929 (Apple) available from J. E. Sozio, Inc. (Edison, N.J.); Citrus SZ-6242 available from J. E. Sozio, Inc. (Edison, N.J.); and MF 3773 (lemon) available from Mane, USA (Wayne, N.J.). Commercially available preservatives suitable for use in the present invention include, but are not limited to, preservatives sold under the trade designation UCARCIDE®, available from (Union Carbide Corp., Danbury, Conn.), such as UCARCIDE® 250.

B. Solid Cleaning Product Physical Size, Shape and Product Configuration

The solid cleaning products of the present invention may have a variety of sizes and shapes depending on a number of factors including, but not limited to, the type of application (e.g., single-use versus multiple-use applications), processing parameters, the desired amount of use solution, the product dispenser used, etc.

1. Solid Cleaning Product Physical Shape

The solid cleaning products of the present invention include one or more of the above-described components, which are formed into a desired shape having a desired size. The solid cleaning products may have any shape or size suitable for use in a product dispenser. For example, the solid cleaning products may be in the form of particles, pellets, beads, tablets, or powders having a size such that hundreds or thousands of pieces of solid cleaning products fill a given product dispenser. The solid cleaning product components may be shaped into larger pieces of solid cleaning product, such as solid masses of conglomerated particles, extruded solid products or cast molded solid products, such that only one or a dozen pieces of solid cleaning product fit within a given product dispenser. Additionally, the solid cleaning product components may be formed into a paste having a conformable solid shape.

In one desired embodiment of the present invention, the solid cleaning product includes an extruded solid cleaning product. The extruded solid cleaning product may have a variety of cross-sectional configurations. In an embodiment, the extruded solid cleaning product has a circular, rectangular, square, pentagon, triangular, hexagonal, arrow-like, rod-like, or star-like cross-sectional configuration. In an embodiment, the extruded solid cleaning product has a circular, rectangular, square, hexagonal, or arrow-like cross-sectional configuration.

In a further desired embodiment of the present invention, the extruded solid cleaning product has a size, which enables one or more pieces of extruded solid cleaning product to be placed within a cavity of a product dispenser, wherein each piece of extruded solid cleaning product has a configuration with increased product surface area due to one or more surface modifications. For example, the extruded solid cleaning product may have a rectangular or square shape, and also have one or more holes through the rectangular or square shape in a direction parallel or perpendicular to a horizontal axis of the extruded solid cleaning product. Other extruded solid cleaning product configurations may include fins or slots within the product to increase the surface area of the product. Suitable extruded solid cleaning product configurations for use in the present invention include, but are not limited to, solid product configurations disclosed in U.S. Pat. No. 6,698,464 filed on May 2, 2002, and entitled "Product Dispenser," the subject matter of which is hereby incorporated herein in its entirety by reference.

2. Solid Cleaning Product Physical Size

The solid cleaning products of the present invention may be provided in a variety of sizes depending of a particular use and application. As discussed above, the solid cleaning product may be in the form of pellets, beads or powders having one or more dimensions (i.e., height, width, length or diameter) of less than 1 centimeter (cm) or less than 1 millimeter (mm). In other embodiments, the solid cleaning product may be in the form of larger pieces such as solid masses of conglomerated particles, extruded solid products or cast molded solid products. The larger pieces of solid product may have at least one dimension (i.e., height, width, length or diameter) of at least 1 centimeter (cm) or greater.

In one exemplary embodiment of the present invention, the solid cleaning product includes an extruded solid cleaning product having at least one dimension (i.e., height, width, length or diameter) of at least 1 centimeter (cm). The extruded solid cleaning products of the present invention may have one or more dimensions (i.e., height, width, length and/or diameter) of up to or greater than about 30.5 cm (12 inches). In certain embodiments, the extruded solid cleaning products of the present invention have a width (or diameter or height) ranging from about 5.1 cm (2 inches) to about 20.3 cm (8 inches), for example, from about 7.6 cm (3 inches) to about 15.2 cm (6 inches).

The extruded solid cleaning products of the present invention can have a length of up to or greater than about 30.5 cm (12 inches). In certain embodiments, the extruded solid cleaning products of the present invention have a length ranging from about 5.1 cm (2 inches) to about 30.5 cm (12 inches), for example, from about 10.2 cm (4 inches) to about 30.5 cm (12 inches).

An exemplary solid cleaning product of the present invention is shown in FIG. 1. As shown in FIG. 1, exemplary solid cleaning product 10 has an upper surface 11, a lower surface 12, and multiple side surfaces 13 separating upper surface 11 from lower surface 12. Exemplary solid cleaning product 10 has a length L and a width W as shown in FIG. 1. Exemplary solid cleaning product 10 further includes optional holes 14 within solid cleaning product 10 and extending along length L from upper surface 11 to lower surface 12. Holes 14 within solid cleaning product 10 increase the surface area of solid cleaning product 10 that may be contacted with water during the production of a liquid use cleaning solution.

Figure 2:
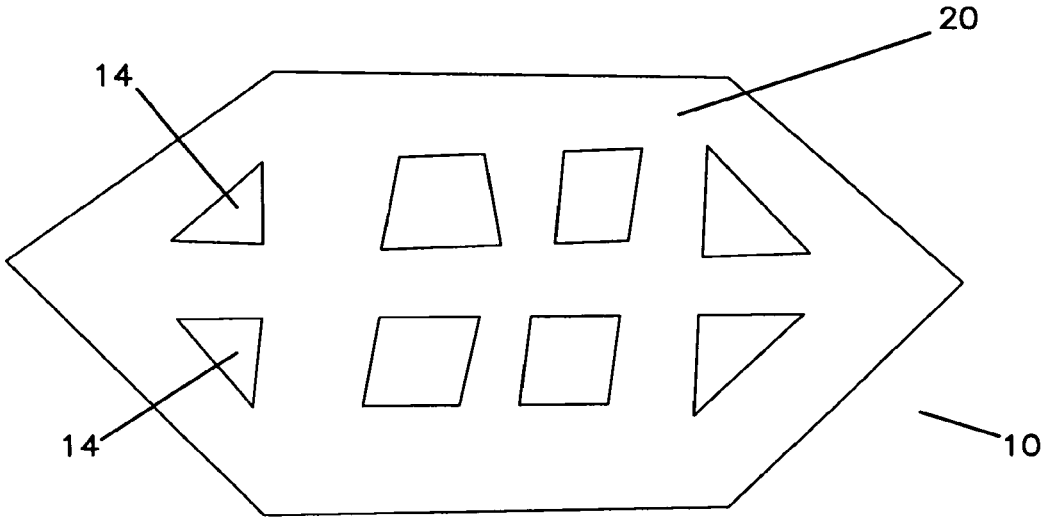
FIG. 2 depicts a cross-sectional view of the exemplary solid cleaning product shown in FIG. 1 along line A-A.

A cross-sectional view of exemplary solid cleaning product 10 along line A-A (shown in FIG. 1) is shown in FIG. 2. Holes 14 are shown along a cross-sectional surface 20 in FIG. 2. It should be noted that holes 14 within exemplary solid cleaning product 10 are optional. When present, holes 14 may have any size and shape as desired in order to produce a desired surface area. Further, the number of holes 14 may vary depending on a number of factors including, but not limited to, the cross-sectional area of exemplary solid cleaning product 10, the water-solubility of exemplary solid cleaning product 10, and the desired concentration of the resulting liquid use cleaning solution.

3. Solid Cleaning Product Configuration

The solid cleaning products of the present invention may further include a protective coating or film layer encapsulating the above-described solid product. Optional protective coating or film layers may be used to protect a user from direct exposure to any of the above-mentioned ingredients within the solid cleaning product. Suitable protective coating layers include, but are not limited to, water-soluble or water-degradable coatings and films, and temporary packaging materials.

In one embodiment of the present invention, the protective layer includes a water-soluble or water-degradable coating or film encapsulating the solid cleaning product. Suitable water-soluble or water-degradable materials for use in the present invention include, but are not limited to, polyvinyl alcohol. In an embodiment, the water-soluble material includes polyvinyl alcohol with or without acetyl groups, cross-linked or uncross-linked.

The protective coating or film layer may contain any water-soluble material(s) alone or in combination with water-insoluble materials. In an embodiment, the construction of the protective coating or film layer is such that the protective coating or film layer either (1) completely dissolves or (2) breaks up into small particles or pieces when exposed to water.

In some embodiments of the present invention, the protective coating or film layer includes water-soluble material alone or in combination with water-insoluble material. When water-insoluble materials are used to form a protective coating or film layer, for example, less than about 50 percent by weight (wt-%) of water-insoluble material is used in combination with at least about 50 percent by weight (wt-%) of water-soluble material to form the protective coating or film layer, based on a total weight of the protective coating or film layer. For example, the protective coating or film layer includes at least about 70 wt-% of water-soluble material and less than about 30 wt-% of water-insoluble material, or, for example, at least about 90 wt-% of water-soluble material and less than about 10 wt-% of water-insoluble material, based on a total weight of the protective coating or film layer.

In a further embodiment, the protective coating or film layer consists essentially of water-soluble material. As used herein, the term "consists essentially of water-soluble material" refers to a protective coating or film layer that contains one of more water-soluble materials, and possibly a filler material, colorant, or other inert material. In yet a further embodiment, the protective coating or film layer consists of water-soluble material. As used herein, the term "consists of water-soluble material" refers to a protective coating or film layer that contains only one of more water-soluble materials without additional components.

The protective coating or film layer may have an average coating or film thickness that varies depending upon a number of factors including, but not limited to, the water solubility of the coating or film material, and the solid cleaning product components. In certain embodiments, the protective coating or film layer has an average coating or film thickness of less than about 1000 microns (μm), for example, from about 10 to about 500 μm, or, for example, from about 25 to about 75 μm.

A variety of commercially available water-soluble films may be used in the present invention. Exemplary water-soluble films suitable for use in the present invention include, but are not limited to, water-soluble films commercially available under the trade designation MONOSOL® from Mono-Sol, LLC (Portage, Ind.), such as MONOSOL® products M-8534, M-8630, M-9500, M-7061, M-7031 and M-7030.

In a further embodiment of the present invention, the protective layer includes a removable packaging film. The removable packaging film may exhibit some adhesion to an outer surface of the solid cleaning product, but may be easily removed. Suitable removable packaging films for use in the present invention include, but are not limited to, a polymeric film (e.g., polyethylene film) or a paper substrate.

II. Methods of Making Solid Cleaning Products

The present invention is further directed to a method of making solid cleaning products. The method of making solid cleaning products may include a variety of process steps depending on the desired configuration of the final solid cleaning product. In an exemplary method of making solid cleaning products, the method includes the steps of: (i) adding one or more solid cleaning product components to a mixing vessel; and (ii) mixing the one or more solid cleaning product components via a mechanical stirrer for a desired period of time.

As described above, the solid cleaning products of the present invention may include one or more liquid components, such as a nonionic surfactant. When liquid components are present, an exemplary method of making solid cleaning products of the present invention may include the steps of: (i) adding one or more liquid components to a mixing vessel; (ii) stirring the one or more liquid components to a mixing vessel; and, while stirring, (iii) adding one or more solid components of the solid cleaning product to a mixing vessel.

In one desired embodiment of the present invention, the method of making solid cleaning products includes an extrusion step. In this embodiment, the method of making solid cleaning products of the present invention may include the following steps: (i) mixing one or components of the solid cleaning product in a mixing vessel to form a first mixture; and (ii) extruding the first mixture through an extrusion die to form an extruded solid cleaning product.

In a further desired embodiment of the present invention, the method of making solid cleaning products includes one or more of the following steps: (i) mixing one or more solid components of the solid cleaning product in a first mixing vessel to form a first mixture; (ii) mixing one or more liquid components of the solid cleaning product in a second mixing vessel to form a second mixture; (iii) combining the first and second mixtures to form a single mixture that can be molded or extruded; (iv) introducing one or more solid components of the solid cleaning product into one or more ports of an extruder; (v) introducing one or more solid components of the solid cleaning product into a mold component suitable for forming a molded solid product; (vi) heating one or more sections of the extruder or the mold component; (vii) extruding one or more solid components of the solid cleaning product through an extrusion die to form an extruded solid cleaning product; and (viii) removing the solid product from the mix tank or mold component. The method may further include one or more of the following steps: (a) cutting the solid cleaning product to a desired length, (b) forming one or more holes or other surface modifications in the solid product (e.g., drill holes, etc.); (c) applying a water-soluble coating onto the solid cleaning product, and/or (d) packaging the solid cleaning product in a removable packaging material, such as a shrink wrap packaging material.

In the above-described method, the step of introducing the first and second mixtures into one or more ports of an extruder may further include introducing the first mixture into a first port of an extruder; introducing the second mixture into a second port of the extruder downstream (or upstream) from the first port to form a combined mixture; and then extruding the combined mixture through an extrusion die to form an extruded solid cleaning product.

Suitable extrusion methods for making the extruded solid products of the present invention include, but are not limited to, extrusion methods disclosed in U.S. Pat. Nos. 6,608,023 and 6,387,870, the subject matter of both of which is hereby incorporated by reference in its entirety.

III. Product Dispensing Systems

The present invention is further directed to product dispensing systems including a product dispenser, and a solid cleaning product as described above. The product dispensing systems of the present invention include one or more system components for converting the above-described solid cleaning product into a liquid "use" solution. A variety of product dispensers may be used in with the above-described solid cleaning product of the present invention. The product dispenser enables the interaction of water with one or more water-dissolvable solid cleaning products. The product dispenser may have any configuration, shape and size, which enable water to come into contact with the one or more water-dissolvable solid cleaning products. Although reference may be made to a particular size and shape, it should be understood that the product dispensers used in the present invention are not limited in any way to a particular design, size or shape.

The product dispensers suitable for use in the present invention can include a number of components. In one embodiment, the product dispenser includes (i) a housing having a cavity configured and arranged to receive a solid cleaning product, wherein the housing has a bottom, a top, and at least one side defining the cavity; (ii) an inlet for inputting water into the housing; (iii) an outlet on the bottom of the housing in addition to the inlet; and (iv) an optional support member positioned within the cavity, wherein at least a portion of the support member is positioned at a distance, d, above the outlet of the housing. In some embodiments of the present invention, the inlet for inputting water into the housing and the outlet for allowing a use solution to exit the housing are the same opening. Each component of the product dispenser provides a given function so as to produce a desired use solution having a desired concentration of solid cleaning product therein.

The product dispenser may include a solid cleaning product support member positioned within the cavity of the housing. The support member may have a solid continuous structure, such as a metal foil or plastic film, or may have a discontinuous, permeable structure, such as a mesh or screen formed from materials including, but not limited to, metals, plastics, and combinations thereof. In one embodiment of the present invention, the support member includes a continuous structure in a horizontal plane within the cavity of the product dispenser, wherein the upper surface area of the support member is less than the surface area of the horizontal plane such that water may flow through the horizontal plane from below the continuous structure to contact the water-dissolvable solid cleaning product positioned on the continuous structure. It should be noted that the support member may have a configuration other than one, which is within a single horizontal plane within a cavity of the product dispenser. For example, the support member may have a V-shape, U-shape, W-shape or any other configuration as long as the support member is capable of supporting a water-dispersible solid cleaning product within the product dispenser.

In a further embodiment of the present invention, the support member includes a permeable structure in a horizontal plane within the cavity of the product dispenser, wherein the upper surface area of the support member is less than or equal to the surface area of the horizontal plane such that water may flow through and/or around the support member from below the permeable structure to contact the water-dissolvable product positioned on the support member. As discussed above, the permeable support member may have a configuration other than one, which is within a single horizontal plane within a cavity of the product dispenser. For example, the permeable support member may have any of the configurations described above (i.e., V-shape, U-shape, W-shape, or other shape).

A portion of the support member may be positioned at a distance, d, above the outlet of the housing. For support members having a V-shape, U-shape, or W-shape as described above, the lower portion of the support member may actually rest on an upper surface of the outlet of the housing. In other embodiments, the lower portion of the support member having a V-shape, U-shape, or W-shape may be at a distance, d, above the outlet of the housing, while an upper portion of the support member is positioned at a distance, (d+t), above the outlet of the housing, wherein t represents the overall thickness of the support member.

The product dispenser further includes one or more openings to allow access to the housing so that solid cleaning product may be positioned in the housing. Each opening may be sealed with an attachable cover to seal the housing after loading the product dispenser with solid cleaning product. In an embodiment, the product dispenser has a single opening and attachable cover for providing access to the product dispenser cavity. Each of the one or more covers may be separable from and removable from the product dispenser or may be attached to the product dispenser using any conventional method of attaching. In one embodiment, a hinge is used to attach a cover to the product dispenser, so that the cover may be removed and reconnected to the product dispenser without being detached from the product dispenser.

The product dispenser may be formed from any material having structural integrity and being unreactive to water and solid cleaning product. Suitable materials for forming the product dispenser include, but are not limited to, plastics, glass, ceramics, metal or any combination thereof. In an embodiment, the product dispenser includes a clear or transparent plastic cover material, which allows a visual inspection of any solid cleaning product in the cavity. In one embodiment of the present invention, at least a portion of the product dispenser includes a transparent material to allow a visual inspection of one or more portions of the product dispenser, for example, at least the interior of the cavity and any solid cleaning product therein. As described below, the product dispenser can be formed from a material that can withstand up to about 689.5 kPa (100 psi) of water pressure exerted on the cavity surfaces of the product dispenser.

Figure 3:
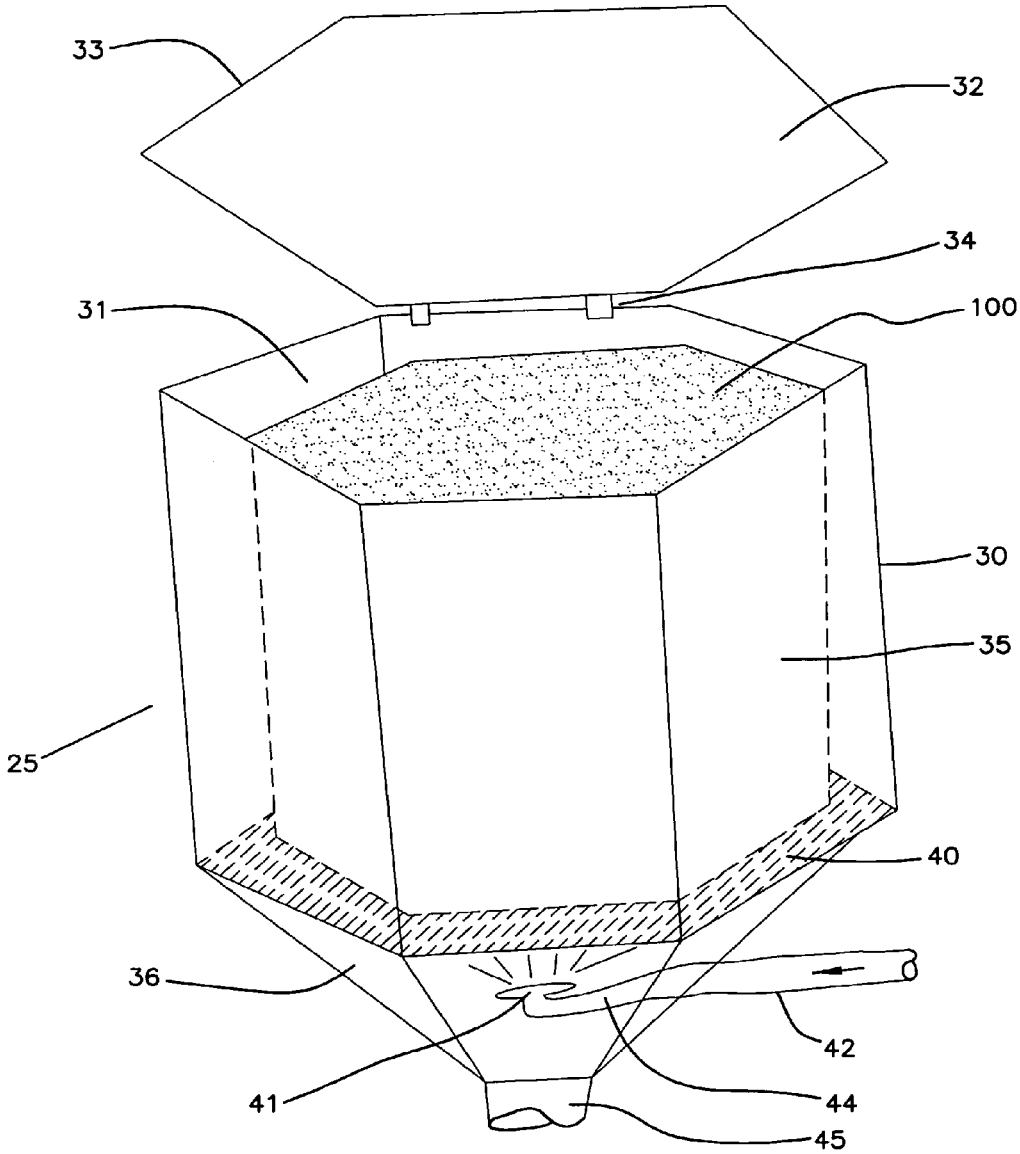
FIG. 3 depicts an exemplary product dispensing system of the present invention.

An exemplary product dispenser is shown in FIG. 3. As shown in FIG. 3, exemplary product dispenser 25 includes housing 30 including cavity 31 surrounded by upper surface 32 (located on the lower surface of cover 33 attached to housing 30 via hinges 34), at least one side wall 35, and bottom surface 36. As shown in FIG. 3, support member 40 supports solid cleaning product 10 positioned within cavity 31 of product dispenser 25. Product dispenser 25 may further include one or more product spray nozzles 41 positioned below support member 40, when present.

As shown in FIG. 3, water enters product dispenser 25 through product dispenser inlet 42. Once inside product dispenser 25, water flows through spray nozzle conduit 44 to one or more product spray nozzles 41. Water exiting product spray nozzle 41 comes into contact with water-soluble solid cleaning product 100 and produces a liquid use solution, which exits product dispenser 25 through product dispenser outlet 45.

As discussed above, product dispenser 25 may have a size and shape so that the product dispenser matches a given water source and/or a container or vessel for receiving the use solution. In one exemplary embodiment of the present invention, the product dispenser has a circular shape; however, it should be understood that other shapes are within the scope of the present invention. Suitable shapes include, but are not limited to, a rectangular shape, a square shape, a hexagonal shape, a triangular shape, a star shape, an arrow shape, a rhombus shape, a trapezoid shape, etc. In an embodiment, the product dispenser has dimensions slightly greater than a solid cleaning product to be used in the product dispenser. Exemplary dimensions are as follows: an overall height ranging from about 7.6 cm (3.0 inches) to about 45.7 cm (18.0 inches); an overall width ranging from about 5.1 cm (2.0 inches) to about 30.5 cm (12.0 inches); and a height of at least a portion of product support member 40 above product dispenser outlet 45 ranging from greater than 0 to about 15.2 cm (6.0 inches).

In one embodiment of the present invention, the product dispenser includes a cavity, wherein the cavity has a cross-sectional configuration, which matches a cross-sectional configuration of the solid cleaning product to be used in the product dispenser. In this embodiment, the solid cleaning product fits into the cavity of the product dispenser in such a way that a user cannot incorrectly input the solid cleaning product into the cavity of the product dispenser without altering the configuration of the solid cleaning product. Suitable cavity/solid cleaning product cross-sectional configurations for use in this embodiment of the present invention include, but are not limited to, a star-like cross-sectional configuration, an arrow cross-sectional configuration, and a diamond cross-sectional configuration.

When solid cleaning product is placed in the product dispenser, the solid cleaning product can have a total volume equal to or less than a cavity volume bordered by the top of the housing, the support member, and at least one side of the housing. One or more pieces of solid cleaning product may be used to fill the cavity volume. In an embodiment, the one or more pieces of solid cleaning product may be stacked one on top of the other to fill the cavity volume, and also provide a consistent surface area of solid cleaning product within a horizontal plane of solid cleaning product as one moves along a vertical direction within the product dispenser cavity. Such a configuration enables a consistent dispersion of solid cleaning product into the water, which contacts the solid cleaning product.

As discussed above, the product dispenser may have any dimensions necessary for a given application. For more continuous applications wherein an amount of solid cleaning product is used on a continuous basis, the dimensions of the product dispenser may be selected such that the cavity has relatively small cross-sectional dimensions when compared to the height of the cavity. In this embodiment, numerous solid cleaning products may be stacked on top of one another.

The product dispensing systems of the present invention accurately dispense cleaning, and/or sanitizing products. Other uses and applications where dispensing of a solid product is desired are also possible with the present invention, and the product dispensers disclosed herein could be used with a variety of containers or other use solution receiving devices.

IV. Methods of Making a Liquid Use Solution

The present invention is further directed to a method of making a liquid use solution. The method may include: (i) positioning a product dispensing system, a water source, and a container (or other receiving device) relative to one another; (ii) placing one or more pieces of solid cleaning product within a product dispenser of the product dispensing system; (iii) causing water to enter into the product dispenser such that the water comes into contact with the solid cleaning product for a desired contact time to form a use solution; optionally, (iv) collecting the use solution that exits the product dispenser for storage; and, if necessary, (v) transporting the use solution to a receiving vessel.

The method may produce a use solution for use in a variety of containers or other receiving devices. Suitable receiving devices for use in the present invention include, but are not limited to, a bucket, and a sink. In one desired embodiment of the present invention, the method produces a floor cleaning solution and the receiving device is a bucket.

The method of the present invention may be used to prepare a use solution having a desired concentration of solid product within an aqueous solution. A number of variable may be considered to obtain a desired use solution concentration including, but not limited to, the contact time between the water and the solid cleaning product, the water temperature, the dissolving rate of the solid cleaning product, the chemical formulation of the solid cleaning product, the shape of the solid cleaning product, the amount of surface area of the solid cleaning product, and the water flow rate into and out of the product dispenser. By adjusting one or more of the above variables, a use solution concentration may be obtained within a desired length of time.

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLES

The materials shown in Table 1 are used in the examples below.

TABLE 1

Solid Cleaning Product Components Used In Examples

| Trade Name | Chemical Name | Description |
|---|---|---|
| NACCONOL ® 90G | sodium dodecylbenzene sulfonate | anionic surfactant |
| citric acid, anhydrous granular | 2-hydroxy-1,2,3-propane-tricarboxylic acid | acid |
| sodium citrate dihydrate, granular | trisodium-2-hydroxy-1,2,3-propanetricarboxylate dihydrate | builder/buffer |
| SURFONIC ® L12-6 | $C_{10}$-$C_{12}$ ethoxylated alcohol | nonionic surfactant |
| sodium sulfate | sodium sulfate | process aid |
| urea | urea | process aid |
| EDTA acid powder | EDTA acid powder | chelating agent |
| Bright Green LX6545 | Bright Green LX6545 | dye |
| Herbal Perfume SZ-6249 | Herbal Perfume SZ-6249 | fragrance |

Example 1

Preparation of Solid Cleaning Product

A composition was prepared using the following components:

| | |
|---|---|
| NACCONOL ® 90G | 49.79 g |
| Citric acid | 20.00 g |
| Sodium citrate dihydrate | 15.00 g |
| SURFONIC ® L12-6 | 15.00 g |
| Bright Green LX6545 | 0.01 g |
| Herbal Perfume SZ-6249 | 0.20 g |

The ingredients were added to a mixing vessel, while stirring, in the following order: NACCONOL® 90G, citric acid and sodium citrate dihydrate. A liquid pre-mixture was prepared from the SURFONIC® L12-6, Bright Green LX6545 and Herbal Perfume SZ-6249. The liquid pre-mixture was then added slowly into the solid mixture to form a solid cleaning product having a powder consistency. The resulting solid product had a water content of less than about 0.99 wt % based on a total weight of the solid product.

The solid cleaning product was added to water to form aqueous use solutions containing about 1.0 part solid cleaning product and 640 parts water. The resulting use solution was used to effectively remove grease and polymerized soil from quarry tile floors.

Example 2

Preparation of Solid Cleaning Product

A composition was prepared using the following components:

| | |
|---|---|
| NACCONOL ® 90G | 49.79 g |
| Citric acid | 17.00 g |
| Sodium citrate dihydrate | 13.00 g |
| SURFONIC ® L12-6 | 15.00 g |
| Sodium sulfate | 5.00 g |
| Bright Green LX6545 | 0.01 g |
| Herbal Perfume SZ-6249 | 0.20 g |

The ingredients were added to a mixing vessel, while stirring, in the following order: NACCONOL® 90G, citric acid, sodium citrate dihydrate and sodium sulfate. A liquid pre-mixture was prepared from the SURFONIC® L12-6, Bright Green LX6545 and Herbal Perfume SZ-6249. The liquid pre-mixture was then added slowly into the solid mixture to form a solid cleaning product having a powder consistency. The resulting solid product had a water content of less than about 0.99 wt % based on a total weight of the solid product.

The solid cleaning product was added to water to form aqueous use solutions containing about 1.0 part solid cleaning product and 640 parts water. The resulting use solution was used to effectively remove grease and polymerized soil from quarry tile floors.

Example 3

Preparation of an Extruded Solid Cleaning Product

An extruded solid cleaning product was prepared using the same composition as shown in Example 1. A commercially available extruder was used to extrude the composition using an extrusion procedure similar to the extrusion process disclosed in U.S. Pat. No. 6,387,870, the subject matter of which is hereby incorporated by reference in its entirety. The feed stream of materials into the extruder was as shown in Table 2:

TABLE 2

| Feed Stream Of Materials Into Extruder | |
|---|---|
| Feed Stream | WT-% |
| NACCONOL ® 90G | 49.79% |
| Citric acid | 20.00% |
| Sodium citrate dihydrate | 15.00% |
| Liquid pre-mixture | 15.21% |
| Total | 100.00% |

The equipment was set-up at known settings suitable for extruding such a composition including those listed in Table 3.

TABLE 3

| Equipment Settings | |
|---|---|
| Equipment Feature | Setting |
| Die Section | Hexagonal shape |
| Screw configuration | Standard, all conveying with a reverse on the end. |
| Block Conveying | Scrap drums at extruder discharge. |

TABLE 3-continued

| Equipment Settings | |
|---|---|
| Equipment Feature | Setting |
| Handling | Set up conveying so that blocks may be shrink wrapped immediately. Set up system so that blocks manually tip onto a conveying system. |

The following process steps were used to prepare extruded solid cleaning products:

(1) the ingredients of the feed streams were added to feeders;

(2) the flow rates of the feed streams of the extruder were calibrated;

(3) the extruder was started;

(4) the feed streams were fed to the extruder;

(5) extruding the feed mixture;

(6) if necessary, applying back pressure to the extrudate;

(7) cutting the extrudate; and (8) shrink wrapping the extruded solid cleaning product.

The resulting extruded solid product had a water content of less than about 0.99 wt % based on a total weight of the solid product. The extruded solid cleaning product was placed in a product dispenser system similar to the exemplary product dispenser system shown in FIG. 3. Water was brought into contact with the extruded solid cleaning product in the product dispenser system to form an aqueous use solution containing 1.0 part solid cleaning product and 640 parts water. The resulting use solution was used to effectively remove grease and polymerized soil from quarry tile floors.

Example 4

Preparation of an Extruded Solid Cleaning Product

An extruded solid cleaning product was prepared as described in Example 3 except that the composition as shown in Example 2 was used to prepare the extruded solid cleaning product. The feed stream of materials into the extruder was as shown in Table 4:

TABLE 4

| Feed Stream Of Materials Into The Extruder | |
|---|---|
| Feed Stream | WT-% |
| NACCONOL ® 90G | 49.79% |
| Citric acid | 17.00% |
| Sodium citrate dihydrate | 13.00% |
| Sodium sulfate | 5.00% |
| Liquid pre-mixture | 15.21% |
| Total | 100.00% |

The resulting extruded solid product had a water content of less than about 0.99 wt % based on a total weight of the solid product. The extruded solid cleaning product was placed in a product dispenser system similar to the exemplary product dispenser system shown in FIG. 3. Water was brought into contact with the extruded solid cleaning product in the product dispenser system to form an aqueous use solution containing 1.0 part solid cleaning product and 640 parts water. The resulting use solution was used to effectively remove grease and polymerized soil from quarry tile floors.

Example 5

Preparation of an Extruded Solid Cleaning Product

An extruded solid cleaning product was prepared as described in Example 3 except that the composition was as shown below:

Liquid Pre-Mixture:

| | |
|---|---|
| SURFONIC ® L12-6 | 197.20 g |
| Bright Green LX6545 | 0.10 g |
| Herbal Perfume SZ-6249 | 2.60 g |

The feed stream of materials into the extruder was as shown in Table 5 below:

TABLE 5

Feed Stream Of Materials Into The Extruder

| Feed Stream | WT-% |
|---|---|
| NACCONOL ® 90G | 44.79% |
| Urea | 10.00% |
| Citric acid | 20.00% |
| Sodium citrate dihydrate | 15.00% |
| Liquid pre-mixture | 10.21% |
| Total | 100.00% |

The resulting extruded solid product had a water content of less than about 0.89 wt % based on a total weight of the solid product. The extruded solid cleaning product was placed in a product dispenser system similar to the exemplary product dispenser system shown in FIG. 3. Water was brought into contact with the extruded solid cleaning product in the product dispenser system to form an aqueous use solution containing 1.0 part solid cleaning product and 640 parts water. The resulting use solution was used to effectively remove grease and polymerized soil from quarry tile floors.

Example 6

Preparation of Solid Cleaning Product

A composition was prepared using the following components:

| | |
|---|---|
| NACCONOL ® 90G | 219.61 g |
| Citric acid | 3.88 g |
| Sodium citrate dihydrate | 12.13 g |
| SURFONIC ® L12-6 | 24.07 g |
| EDTA powder | 39.68 g |
| Bright Green LX6545 | 0.03 g |
| Herbal Perfume SZ-6249 | 0.60 g |

The ingredients were added to a mixing vessel, while stirring, in the following order: NACCONOL® 90G, citric acid, EDTA powder and sodium citrate dihydrate. A liquid pre-mixture was prepared from the SURFONIC® L12-6, Bright Green LX6545 and Herbal Perfume SZ-6249. The liquid pre-mixture was then added slowly into the solid mixture to form a solid cleaning product having a powder consistency. The resulting solid product had a water content of less than about 1.47 wt % based on a total weight of the solid product. The solid cleaning product was added to water to form aqueous use solutions containing about 1.0 part solid cleaning product and 640 parts water. The resulting use solution was used to effectively remove grease and polymerized soil from quarry tile floors.

Example 7

Preparation of an Extruded Solid Cleaning Product

An extruded solid cleaning product was prepared as described in Example 3 except that the composition was as shown below:

Liquid Pre-Mixture:

| | |
|---|---|
| SURFONIC ® L12-6 | 80.20 g |
| Bright Green LX6545 | 0.10 g |
| Herbal Perfume SZ-6249 | 2.60 g |

The feed stream of materials into the extruder was as shown in Table 6 below:

TABLE 6

Feed Stream Of Materials Into The Extruder

| Feed Stream | WT-% |
|---|---|
| NACCON ® 90G | 73.20% |
| Citric acid | 1.34% |
| Sodium citrate dihydrate | 4.00% |
| EDTA acid powder | 13.23% |
| Liquid pre-mixture | 8.23% |
| Total | 100.00% |

The resulting extruded solid product had a water content of less than about 1.46 wt % based on a total weight of the solid product. The solid cleaning product was placed in a product dispenser system similar to the exemplary product dispenser system shown in FIG. 3. Water was brought into contact with the extruded solid cleaning product in the product dispenser system to form an aqueous use solution containing 1.0 part solid cleaning product and 640 parts water. The resulting use solution was used to effectively remove grease and polymerized soil from quarry tile floors.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

All publications and patent applications in this specification are indicative of the level of ordinary skill in the art to which this invention pertains.

The invention has been described with reference to various specific and preferred embodiments and techniques. However, it should be understood that many variations and modifications may be made while remaining within the spirit and scope of the invention.

What is claimed is:

1. A method of cleaning floors comprising:

(a) providing a multi-use solid composition, the solid composition consisting of:

(i) from about 5 to about 35 wt. % of anhydrous citric acid granules;

(ii) from about 35 to about 65 wt. % of sodium dodecylbenzene sulfonate;

(iii) from about 5 to about 25 wt. % of a $C_{10}$ to $C_{12}$ ethoxylated alcohol;

(iv) from about 5 to about 25 wt. % of sodium citrate dihydrate;

(v) up to about 20 wt. % urea; and (vi) 0 wt. % to 1 wt. % unbound water;

(b) placing the solid composition in a dispenser comprising a housing with a cavity configured to receive the solid composition;

(c) dissolving a portion of the solid composition with water to form a use solution; and (d) applying the use solution to a floor.

2. The method of claim 1, wherein the composition is in the form of a solid block.

3. The method of claim 1, wherein the composition is in the form of a pellet, bead, or powder.

4. The method of claim 1, wherein the composition is in the form of a solid mass of conglomerated particles, an extruded composition, or a cast molded solid.

5. The method of claim 1, the composition further comprising a chelating agent.

6. The method of claim 5, wherein the chelating agent is selected from the group consisting of polyaspartic acid, sodium gluconate, sodium glucoheptonate, trisodium N-hydroxyethylene diamine triacetate, trisodium salt of methyl glycine diacetic acid, ethylenediaminetetraacetic acid or sodium salt thereof, diethylenetriaminepentaacetic acid or sodium salt thereof, sodium salt of neutralized or partially neutralized polyacrylic acid, and mixtures thereof.

7. The method of claim 1, the method further comprising allowing the use solution to remain in contact with the floor for a sufficient time to remove soil from the floor.

8. The method of claim 1, wherein the floor comprises quarry tile.

* * * * *